United States Patent [19]

Mathis et al.

[11] 4,117,547

[45] Sep. 26, 1978

[54] APPARATUS FOR THE PREPARATION OF MORTAR OR THE LIKE

[75] Inventors: Paul Mathis, Freiburg-Lehen; Max Zimmer, Istein, both of Fed. Rep. of Germany

[73] Assignee: Mathis Fertigputz GmbH, Fed. Rep. of Germany

[21] Appl. No.: 690,276

[22] Filed: May 26, 1976

[30] Foreign Application Priority Data

May 27, 1975 [DE] Fed. Rep. of Germany ..... 2523374
Sep. 29, 1975 [DE] Fed. Rep. of Germany ..... 2543379

[51] Int. Cl.[2] ..... B28C 7/14

[52] U.S. Cl. ..... 366/17; 366/20; 366/29; 366/33; 366/50; 366/131; 366/142; 366/139

[58] Field of Search ..... 259/161, 178 R, 162, 259/169, 170, 165, 164, 154; 417/900, 426; 415/143; 302/59, 23; 55/385; 141/93; 98/115 R; 366/17

[56] References Cited

U.S. PATENT DOCUMENTS

| | | | |
|---|---|---|---|
| 1,423,853 | 7/1922 | Hodgson | 259/169 |
| 1,754,533 | 4/1930 | Kirk | 259/169 |
| 2,946,626 | 7/1960 | Atkinson | 302/23 |
| 3,006,615 | 10/1961 | Mason | 259/165 |
| 3,072,388 | 1/1963 | Ridley | 259/178 R |
| 3,203,631 | 8/1965 | Jutila | 259/178 R |
| 3,236,565 | 2/1966 | Kester | 302/21 |
| 3,807,706 | 4/1974 | Kugle | 259/178 |

*Primary Examiner*—Robert W. Jenkins
*Attorney, Agent, or Firm*—Peter K. Kontler

[57] ABSTRACT

Apparatus for the preparation of mortar has a wheel-mounted frame for an elongated vessel which receives metered quantities of solid and liquid constituents from discrete feeding units. The vessel has an outlet and contains a rotary homogenizing and evacuating device which mixes the solid and liquid constituents to form mortar and advances the mortar toward and through the outlet. Mortar issuing from the outlet of the vessel can be discharged into a separate container which is mounted in or on the frame and is connected with one or more evacuating pumps, into wheelbarrows or into the container of a conventional mortar mixing machine. The feeding unit for solid constituent may receive material by gravity flow or under the action of a rotary screw in a receptacle which is mounted in the frame at a level above the vessel and receives solid constituent from a pneumatic conveyor. The quantities of mortar in the container and of solid constituent in the receptacle are monitored by discrete detector means which arrest one or more prime movers for the moving parts of the apparatus when the quantity of mortar in the container or the quantity of solid constituent in the receptacle exceeds a predetermined quantity. The rates of admission of constituents into and of evacuation of mortar from the vessel are selected in such a way that the vessel contains a constant supply of mortar but is not filled to capacity.

36 Claims, 6 Drawing Figures

1
1A
2
2 1X
3
3A
4
4A
5
6
7
8
9
9a
10
11
12
12A
13
14
15
16
17
18
18A
19
19A
19A
20
21

APPARATUS FOR THE PREPARATION OF MORTAR OR THE LIKE

BACKGROUND OF THE INVENTION

The present invention relates to apparatus for preparation of hardenable plastic building materials, such as mortar, and more particularly to improvements in apparatus which are especially suited for continuous preparation of mortar or the like.

It is already known to connect a vessel, wherein the solid and liquid constituents of mortar are brought in contact with each other, to a pump which is intended to evacuate a continuous stream of mortar. The vessel receives solid and liquid constituents (the liquid constituent is normally water) from discrete sources and contains means for mixing the ingredients so that a constant supply of mortar is available for evacuation by the pump. A drawback of such apparatus is that the pump often causes damming or choking of the chamber with the result that the rate or evacuation from the chamber fluctuates within a rather wide range. This, in turn, causes certain batches of solid constituents to contain more water than the others. The output of the pump increases considerably when the pump evacuates a batch which contains a relatively high percentage of water, and this affects the uniformity or homogeneousness of mixture in the chamber.

SUMMARY OF THE INVENTION

An object of the invention is to provide a novel and improved apparatus for preparation of mortar or other hardenable plastic building materials, which is capable of producing and dispensing a supply of building material characterized by highly satisfactory homogeneousness irrespective of the consistency of its solid constituent.

Another object of the invention is to provide an apparatus which can be utilized for continuous preparation of a wide variety of hardenable plastic building materials of any desired consistency and whose operation can be automated to such an extent that it functions properly for extended periods of time without any or with minimal supervision.

A further object of the invention is to provide an apparatus which can produce a mixture of solid and liquid constituents whose homogeneousness is sufficiently high to insure a minimum of wear on the parts which are used to feed the constituents; to mix the constituents so as to form high-grade concrete, any desired type of mortar and/or other hardenable plastic building materials; and to evacuate one or more continuous streams of building material in desired direction or directions.

A further object of the invention is to provide a simple and rugged apparatus which can be readily transported to and from the locale of use as well as at such locale, which does not contaminate the surrounding area, and which is sufficiently compact to be capable of being used at the outside as well as in the interior of buildings in which the building material is put to use.

Still another object of the invention is to provide an apparatus for the preparation of high-grade concrete, plaster mortar, stucco, masonry mortar, pavement material, and/or other types of hardenable plastic building material containing desired quantities of pulverulent (flour-like), finely comminuted and/or relatively coarse solid constituents and/or desired percentages of cementing agent and filler, which can receive the solid constituent from one or more sources and by resorting to a wide variety of supplying means, and which can produce a highly homogeneous building material irrespective of the selected consistency of its solid constituent and irrespective of the selected ratio of solid to liquid constituent.

A further object of the invention is to provide an apparatus which can be rapidly converted from continuous operation to batch type operation, which can supply homogeneous building material to conventional containers, such as presently known mortar mixers or wheelbarrows, and which can be used in densely populated areas because it does not contaminate the surrounding atmosphere.

An additional object of the invention is to provide an apparatus which can be readily dismantled so that it does not occupy much room in storage and/or during transport to or from the locale of use.

The invention resides in the provision of apparatus for the preparation of hardenable plastic building material which includes solid and liquid constituents, e.g., constituents which can be mixed to form a desired type of mortar. The apparatus is preferablydesigned for continuous preparation of hardenable plastic building material and comprises a mixing vessel which can be mounted on or in the frame of a trailer, first and second feeding means for respectively admitting into the vessel metered quantities of solid and liquid constituents (the first feeding means may comprise a screw conveyor and the second feeding means may include an adjustable valve or another suitable flow metering device) whereby such constituents are converted into building material in the interior of the vessel, and means for evacuating building material from the vessel at such a rate that the quantity of building material in the interior of the vessel is at least substantially constant and the vessel is filled to less than capacity. This can be readily achieved by appropriate adjustment of the two feeding means and/or the evacuating means. In accordance with a presently preferred embodiment of the invention, the evacuating means may include a rotary member which is mounted in the interior of the vessel and includes paddles or analogous means for mixing the solid and liquid constituents as well as for advancing the resulting building material toward an outlet of the vessel so that the material can enter a second vessel or container which is connected with the intake or intakes of one or more pumps serving to remove from the container one or more continuous streams of building material and to direct the stream or streams to the locus or loci of use.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
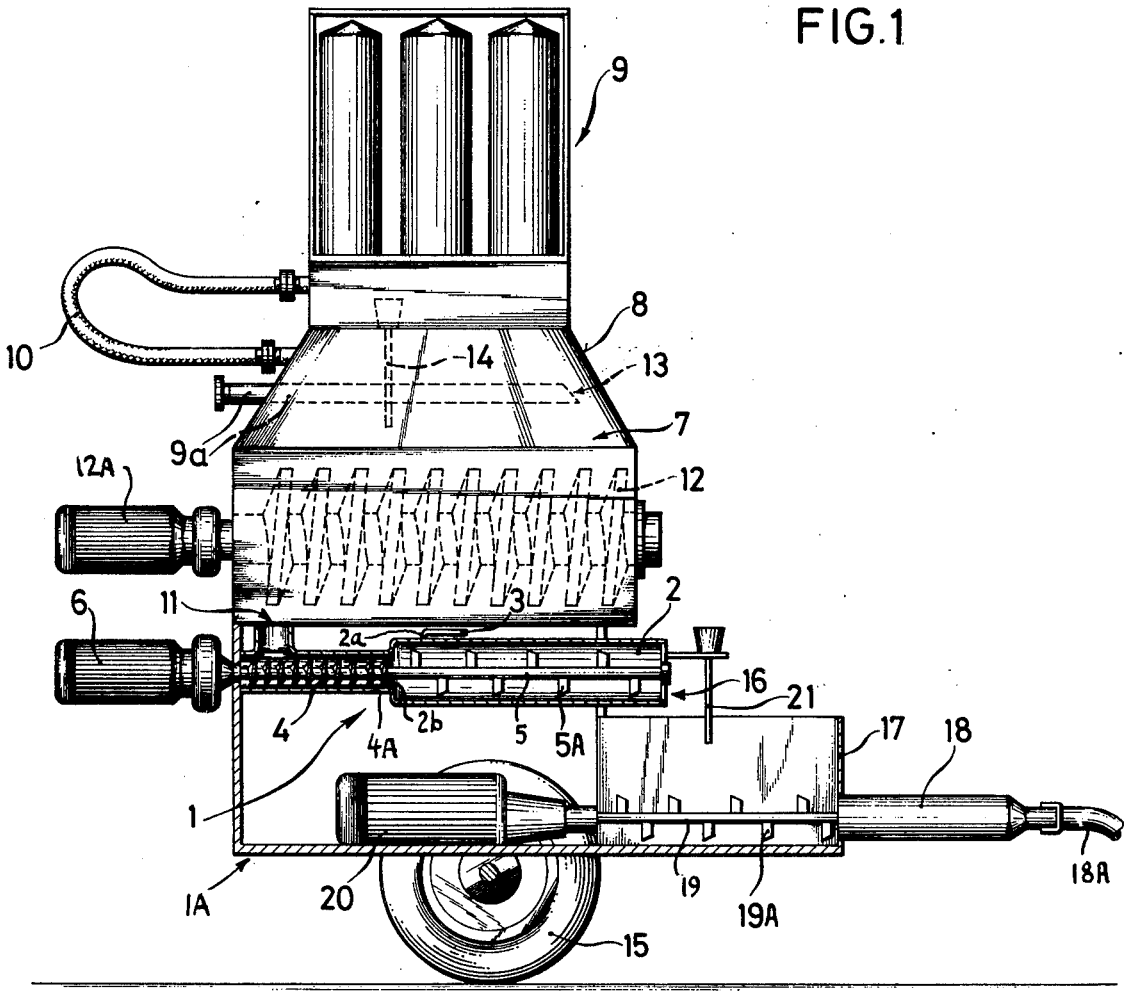
FIG. 1 is a partly elevational and partly sectional view of an apparatus which embodies one form of the invention.
Figure 2:
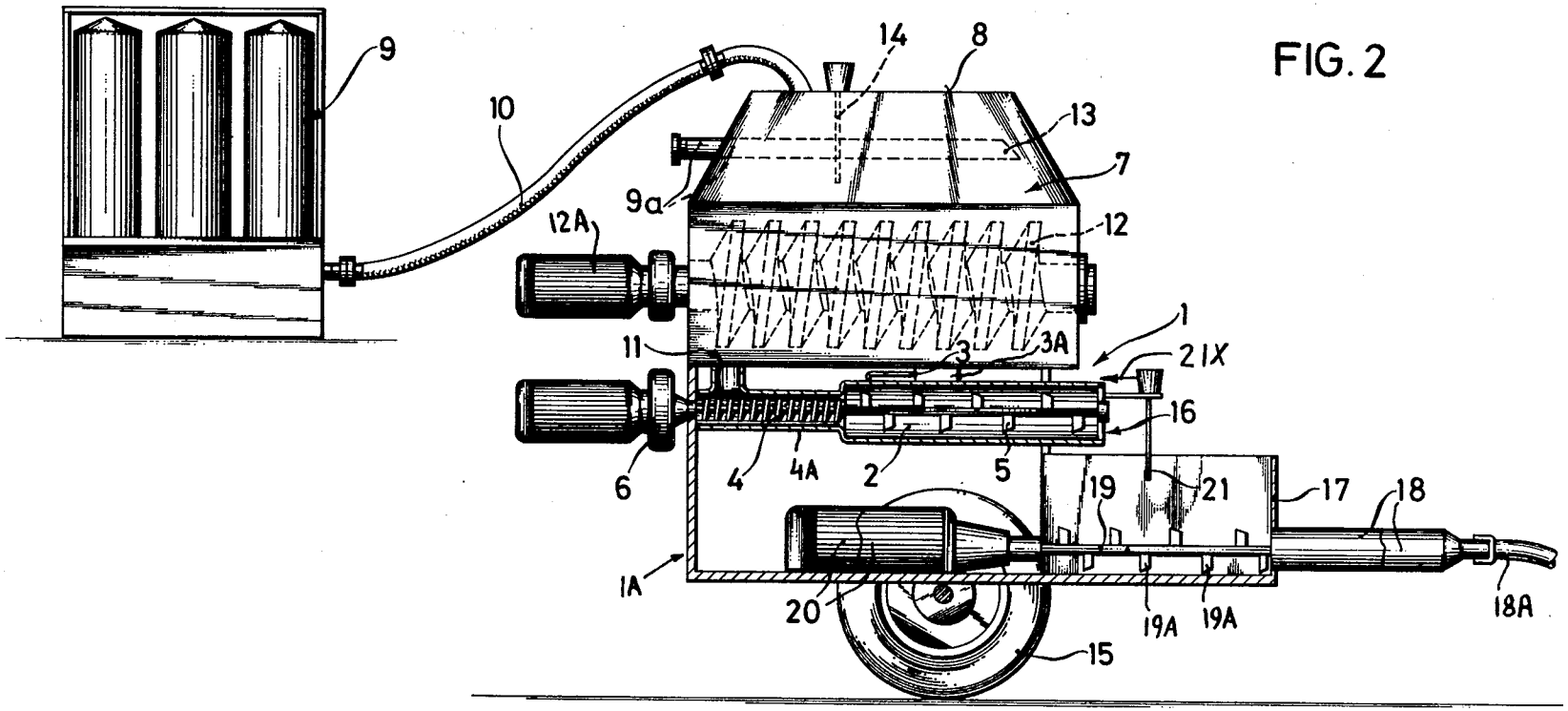
FIG. 2 is a similar view but showing a filtering unit of the apparatus in a different position.
Figure 3:
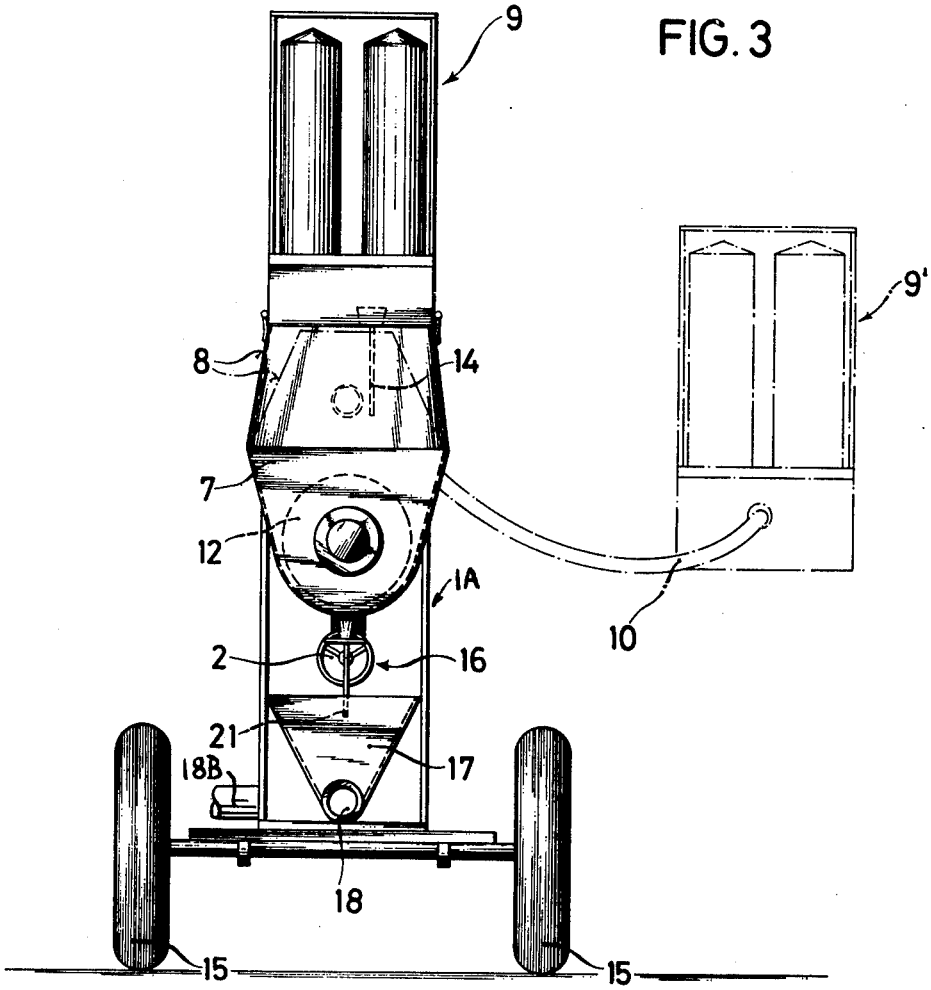
FIG. 3 is a front elevational view of the apparatus as seen from the right-hand side of FIG. 2.

Referring first to FIGS. 1 to 3, there is shown an apparatus 1 which will be described with reference to the preparation of mortar. However, it will be understood that the apparatus 1 is equally suited for the preparation of concrete or other types of hardenable plastic building material which is obtained by mixing a liquid constituent (normally water) with one or more comminuted solid constituents, such as cement, lime, gravel, sand and/or others.

The apparatus of FIGS. 1 to 3 comprises a frame or casing 1A which is mounted on one or more pairs of wheels 15 so that it can be hitched to an automobile, truck or another suitable towing vehicle, not shown. The frame 1A supports a mixing vessel or chamber 2 having an inlet 2*a* which is connected with a feeding unit including a pipe 3 connected to a water tap (not shown) and a metering device 3A, e.g., an adjustable valve which can regulate the rate of water flow into the left-hand portion of the vessel 2, as viewed in FIGS. 1 or 2.

A second inlet 2*b* of the vessel 2 receives a constant stream of a solid constituent from another feeding unit including a screw conveyor having a housing or barrel 4A and a rotary feed screw 4 whose thread advances metered quantities of solid constituent in a direction to the right, as viewed in FIGS. 1 or 2. The housing 4A has an upwardly extending inlet 11 which is remote from the inlet 2*b* and receives a continuous stream of solid constituent from a supply unit including an elongated receptacle 7 mounted in or on the frame 1A at a level above the vessel 2 and housing 4A. The rate at which the inlet 2*a* of the vessel 2 receives water depends on the setting of the valve 3A, and the rate at which the inlet 2*b* receives a solid constituent depends on the speed of the feed screw 4. Such speed can be regulated by a prime mover 6 which includes a variable-speed motor (e.g., a d.c. motor) or a constant-speed motor and a variable-speed transmission. The prime mover 6 has an output shaft which is directly coupled to the feed screw 4.

In the apparatus of FIGS. 1 to 3, the means for evacuating building material (mortar) from the vessel 2 at such a rate that the vessel is filled to less than capacity comprises a shaft 5 or an analogous rotary member which is mounted in the interior of the vessel 2 and has paddles 5A or analogous means for advancing the building material toward and through an outlet 16 at the right-hand end of the vessel, as viewed in FIGS. 1 or 2. The paddles 5A not only advance the material toward the outlet 16 but also perform a desirable mixing action so that the material issuing from the vessel is one of satisfactory homogeneousness which is normally high enough to allow for immediate application to walls, floors or into gaps between neighboring bricks, slates, tiles or the like. The shaft 5 is coaxial with and receives torque directly from the feed screw 4; this simplifies the construction of the apparatus and further insures that the rate of evacuation of building material via outlet 16 is always proportional to the rate of admission of solid constituent via inlet 2*b*. Thus, all that is necessary to insure that the supply of building material in the interior of the vessel 2 remains constant, irrespective of the RPM of the feed screw 4 and shaft 5, is to insure that the rate of water admission via inlet 2*a* is always proportional to rotational speed of the shaft 5. This can be achieved in a simple and efficient manner by resorting to a relatively simple and compact synchronizing system, e.g., to a servomotor which adjusts the valve 3A and whose operation is regulated in response to signals furnished by a tachometer generator which monitors the RPM of the feed screw 4 and/or shaft 5. All that counts is to insure that the vessel 2 is not filled to capacity and that the quantity of building material in the interior of the vessel 2 is at least substantially constant. The common axis of the feed screw 4, shaft 5 and output shaft of the motor 6 is preferably horizontal. This insures that the feed of solid constituent into the vessel 2 and the evacuation of building material from the vessel is not influenced by gravity.

The receptacle 7 is disposed in the interior of a hood or cover 8 which is mounted in or on the frame 1A and may serve as a temporary or permanent support for a filtering unit 9. The latter receives dust-containing air or another suitable gaseous carrier medium for solid constituent which is supplied to the receptacle 7 in admixture with compressed gaseous carrier medium by a pneumatic conveyor including a pipe 9*a* discharging into the conical upper portion of the hood 8 whence the solid constituent descends by gravity to enter the receptacle 7. The carrier medium is evacuated by a conduit 10 (preferably a flexible hose) which connects the hood 8 and receptacle 7 with the filtering unit 9. The unit 9 can discharge cleaned gaseous carrier medium into the surrounding atmosphere.

The filtering unit 9 is preferably remote from the receptacle 7 to provide a relatively long path for travel of gaseous carrier medium from the interior of the hood 8 into the filtering unit. The flexibility of conduit 10 renders it possible to locate the filtering unit 9 on a support other than the frame 1A, e.g., in or close to the open window of a building, and to move the frame 1A to a location at a desired distance from the filtering unit. Thus, the vessel 2 can be moved from room to room (by a distance depending on the length of the conduit 10) while the filtering unit 9 remains stationary at a locus where it can discharge cleaned gaseous carrier medium into the atmosphere.

A relatively long conduit 10 or an analogous connecting element between the filtering unit 9 and hood 8 is desirable on the additional ground that it reduces the likelihood of undesirable fluctuations of pressure in the interior of the receptacle 7; such fluctuations could adversely influence the metering action of the feed screw 4 in the housing 4A of the screw conveyor.

The receptacle 7 communicates with and is preferably detachable from the inlet 11 which is close to the left-hand end of the housing 4A, as viewed in FIGS. 1 or 2, so that the freshly admitted solid constituent travels a considerable distance prior to reaching the inlet 2*b* of the vessel 2. The receptacle 7 preferably contains a feed screw 12 or analogous means for conveying solid constituent toward the inlet 11 of the housing 4A. The feed screw 12 is horizontal and receives torque from a variable-speed prime mover 12A, preferably an electric motor. The feed screw 12 not only advances solid constituent toward the inlet 11 but also performs a desirable mixing or homogenizing function which is particularly important when the solid constituent contains particles of different size. The mixing or homogenizing action of the feed screw 12 is desirable in the apparatus of FIGS. 1 to 3 on the additional ground that the pneumatic conveyor including the pipe 9*a* is likely to effect a certain classification of solid constituent which enters the upper portion of the hood 8 via nozzle 13 at the discharge end of the pipe 9*a*. Thus, the flight spans of heavier solid particles are longer than the flight spans of lighter solid particles and, in the absence of the feed screw 12, the receptacle 7 would be likely to contain batches of lighter particles and batches of heavier particles which would affect the quality of building material in the vessel 2. It will be noted that the nozzle 13 of the pneumatic conveyor pipe 9*a* is remote from the inlet 11 and discharges solid constituent in a direction counter to transport of such material by the feed screw 12. The nozzle 13 is located at a level above the feed screw 12. Such mounting and orientation of the nozzle 13 insures that the solid constituent is invariably subjected to a relatively long-lasting and pronounced mixing and homogenizing action before it reaches the housing 4A via inlet 11. The feed screw 12 further prevents or reduces the likelihood of bridging of solid constituent, i.e., the formation of cavities in the region of the inlet 11; such bridging could adversely influence the metering action of the conveyor including the feed screw 4.

The apparatus 1 further comprises a level detector or probe 14 which extends downwardly into the receptacle 7 and can produce signals serving to arrest the pneumatic conveyor including the pipe 9*a* when the quantity of solid constituent in the receptacle 7 exceeds a predetermined maximum permissible value. The exact manner in which the detector 14 can effect stoppage of the pneumatic conveyor and renewed starting of this conveyor when the quantity of solid constituent in the receptacle 7 respectively exceeds or decreases below a maximum permissible value forms no part of the present invention. The provision of such detector insures automatic regulation of admission of solid constituent in the event of malfunction of those parts of the apparatus which receive solid constituent from the receptacle 7, i.e., it is not necessary to employ an attendant for the purpose of preventing the accumulation of excessive quantities of solid constituent upstream of the mixing vessel 2.

The filtering unit 9 can be separably supported on the hood 8 or elsewhere in or on the frame 1A as well as at a location which is remote from the remaining parts of the apparatus 1. For example, the frame 1A may include a suitable bracket or platform, not shown, which can be used to support the filtering unit 9. If the apparatus 1 is used on a given floor of a building, the flexible conduct 10 renders it possible to leave the filtering unit 9 in a selected area while the frame 1A is moved from room to room. As stated above, the filtering unit 9 can be placed into or close to a window opening to discharge cleaned gaseous carrier medium to the exterior of the building while the 1A moves from room to room or to any other part of the respective floor. The wheels 15 allow for convenient and effortless movement of the frame 1A to different locations inside or outside of a building or construction site.

In order to enhance the versatility of the apparatus 1, the latter preferably further comprises means for applying freshly prepared building material to one or more selected areas. To this end, the frame 1A supports a container or tank 17 which is at least partially open at the top and is mounted in such a way that it receives building material which issues from the vessel 2 via outlet 16 under the action of the paddles 5A on the shaft 5 of mixing and advancing means in the vessel 2. The means for evacuating building material from the container 17 comprises at least one pump 18 connected to a hose 18A which can direct a stream of building material against a wall or into the cracks between bricks, tiles or the like.

In accordance with a presently preferred embodiment of the invention, the apparatus further comprises means for mixing and homogenizing building material in the container 17 as well as for advancing such material toward the intake of the pump 18. Such combined mixing and advancing means may be analogous to that in the vessel 2, i.e., it may comprise a horizontal shaft 19 which is provided with suitably distributed and inclined paddles or vanes 19A. The prime mover 20 for the shaft 19 is accessible at the outer side of the container 17 and its output element is preferably coaxial with the shaft 19. The shaft 19 can further serve to transmit torque to the rotary element or elements of the pump 18, e.g., to the screw of a screw pump.

If desired or necessary, the container 17 can receive two or more parallel or mutually inclined shafts 19 each of which receives torque from a discrete prime mover and each of which can advance building material to the intake of a discrete evacuating pump. For example, the apparatus may comprise two or more parallel shafts 19 whose paddles 19A advance building material in the same direction or in opposite directions and/or one or more shafts which extend transversely of the illustrated shaft (see FIG. 2) and serve to feed building material to one or more pumps (see the pump 18B of FIG. 3) which discharge building material laterally, i.e., toward and/or away from the observer of FIGS. 1 or 2. One or more pumps can be mounted on top of the container 17 to discharge building material upwardly. The provision of two or more pumps is desirable when the capacity of the improved apparatus is sufficient to allow for simultaneous conveying of building material to two or more different locations. The paddles 19A further perform the desirable function of effecting a final mixing and homogenization of building material prior to evacuation from the container 17 by way of the pump or pumps 18.

Each pump 18 may be a screw pump; however, it is equally within the purview of the invention to use evacuating means in the form of reciprocating pumps.

The apparatus 1 further comprises a level detector or probe 21 which extends downwardly into the interior of the container 17 and serves to arrest the two feeding units (for solid and liquid constituents) when the container 17 stores a predetermined maximum permissible quantity of building material. For example, the detector 21 can be used to arrest the prime mover 6 (via operative connection indicated by arrow 21X shown in FIG. 2) and to close the valve 3A. As the pneumatic conveyor pipe 9*a* continues to deliver solid constituent, the level of such constituent rises in the receptacle 7. This is detected by the member 14 which arrests the pneumatic conveyor as soon as the upper surface of solid constituent in the receptacle 7 rises to the maximum permissible level.

It is further desirable to provide the apparatus 1 with means for separably connecting the container 17 with the frame 1A, vessel 2 and/or receptacle 7. Thus, the container 17 can be detached so as to provide room for the placing of other types of containers (e.g., dollies or wheel barrows) below the outlet 16 of the vessel 2.

The incorporation of some or all of the aforediscussed features into the improved apparatus renders it possible to prepare a building material of predictable consistency which remains unchanged as long as necessary and without any or with minimal supervision. This is achieved in part by providing discrete mixing and evacuating means for the building material. Thus, the pump or pumps 18 need not be used to agitate or homogenize material in the container 17; on the contrary, the apparatus preferably comprises means (19, 19A) for mixing the contents of the container 17 and for advancing the contents toward and into the pump or pumps 18. Therefore, the pump or pumps 18 are not likely to block or dam the container 17. Another reason for the absence of blocking and the preparation of a homogeneous building material is that the rates at which the feeding means including the screw 4 delivers solid constituent, at which the feeding means including the valve 3A delivers the liquid constituent, and at which the paddles 5A evacuate building material from the vessel 2 are selected with a view to insure that the quantity of material in the vessel 2 remains constant and that the vessel is not filled to capacity. The pump or pumps 18 could not influence the mixing and evacuating action in and from the vessel 2 even if the mixing means 19, 19A in the container 17 were omitted because the pump or pumps 18 do not receive building material directly from the vessel 2. Still another reason for the preparation of a homogeneous mixture in the vessel 2 is that the pneumatic conveyor including the pipe **9*a* cannot influence the rate at which the inlet 11 receives solid constituent from the receptacle 7. This is achieved by insuring evacuation of gaseous carrier medium via filtering unit 9 in such a way that the pressure in the receptacle 7** fluctuates very little or not at all.

The advantages of operating the apparatus in such a way that the vessel 2 invariably stores a substantially constant supply of building material but is not filled to capacity will be readily appreciated by considering the following: If the vessel 2 were normally filled, any (even very slight) reduction of the rate of evacuation of building material via outlet 16 would immediately result in blocking of the inlet **2*b*, i.e., the screw 4 would be unable to admit additional metered quantities of solid constituent. If the vessel 2 would still allow for admission of at least some water (while preventing the admission of solid constituent), the consistency of building material in the vessel 2 would change immediately because such material would contain an excessive amount of water. The paddles 5A would effect a more rapid evacuation of readily flowable building material having an excessive water content. Consequently, the feeding unit including the screw 4 would be free to abruptly admit a substantial amount of solid constituent which would result in the preparation of a more viscous building material. The evacuation of such building material is slower so that the material would rapidly fill the vessel 2 to again clog the inlet 2*b*** with the result that the mix in the vessel would receive excessive amounts of water.

It has been found that, by preventing the filling of vessel 2 to capacity and by insuring that the quantity of building material in the vessel 2 remains at least substantially constant, the likeihood of clogging of the inlet **2*b* is very remote so that the consistency of the mix in vessel 2 remains unchanged until and unless a change in consistency is effected by appropriate adjustment of the material action of one or both feeding units. The consistency of the mix in the vessel 2 remains unchanged irrespective of the nature of solid constituent which is admitted via inlet 2*b*, i.e., irrespective of the ratio of filler to cement and/or the percentage of lighter, medium-weight and heavier particles in the stream which flows into the housing 4A via inlet 11. The likeihood of clogging of the inlet 2*b* by building material in the vessel 2 is further reduced if the feed screw 4 and shaft 5 are mounted and operated in a manner as shown in FIGS. 1–3, i.e., if the speed of the feed screw 4 invariably changes at the same rate as that of the shaft 5 or vice versa. This insures that the rate of admission of solid constituent via inlet 2*b* is always proportional to the rate of evacuation of building material via outlet 16 of the vessel 2**.

The filtering unit 9 is preferably a large structure which can be traversed by large quantities of air or another gaseous carrier medium per unit of time and which does not offer an excessive resistance to the flow of carrier medium therethrough. This reduces the likelihood of a building of pressure in the interior of the hood 8 and/or receptacle 7 so that the rate at which the screw 12 advances the solid constituent toward the inlet 11 (which is preferably detachably connected with the respective outlet of the receptacle 7) depends only or primarily on the RPM of the prime mover 12A. If the filtering unit 9 were to receive gaseous carrier medium directly from an outlet opening of the receptacle 7 or hood 8, the likelihood of rapid clogging of solids-intercepting means in the filtering unit would be much more pronounced, especially if the apparatus were to prepare stucco, masonry mortar or a like building material containing a solid constituent with a relatively high percentage of minute solid particles. The length of the path for the flow of gaseous carrier medium from the receptacle 7 to the filtering unit influences the ability of gaseous carrier medium to adversely influence the pressure in the receptacle 7. Thus, the pressure of carrier medium decreases if such medium is to cover a relatively long distance from the receptacle to the filtering unit. Moreover, the resistance which a filtering unit offers to the flow of gases therethrough is less likely to cause fluctuations of pressure in the receptacle if the filtering unit is located at a considerable distance from the receptacle (not as concerns its physical position relative to the receptacle but rather as regards the length of the path along which the gases flow from the receptacle into the filtering unit). Furthermore, and as mentioned above, the apparatus can utilize a relatively large filtering unit (especially if such filtering unit need not, or need not always, rest on the hood 8 or another part of or on the frame 1A). A large filtering unit normally offers a relatively low resistance to the flow of gases. FIG. 2 shows the filtering unit 9 behind the frame 1A, and FIG. 3 shows (by phantom lines, as at 9') the filtering unit at a location laterally of the frame.

The provision of paddles 19A in the container 17 insures that the pump 18 cannot feed building material back into the container 17 so that the consistency of such material is predictable and changes only when an operator changes the ratio of solid and liquid constituents in the vessel 2 and/or the nature of solid constituent which is fed by the screw 4. The pump 18 evidently cannot influence the mixing action of paddles 5A in the vessel 2 so that the operation of this pump cannot adversely affect the homogeneousness and/or other characteristics of the mix which is formed in the vessel.

The provision of two or more pumps 18 is especially desirable when the apparatus 1 is used for the preparation of masonry mortar. This insures that streams of mortar can be conveyed simultaneously to two or more spaced-apart parts of a building or the like. Moreover, and if each pump 18 is associated with a discrete set of paddles 19A or analogous mixing and advancing means, the homogenizing action upon the contents of the container 17 is even more satisfactory.

All bulkier components of the improved apparatus are preferably separable from the frame 1A so that the detached components can be stored in a small area, not only when the apparatus is not in use but also during transport to and from a construction site if the apparatus is to be transported in, rather than pulled by, a vehicle. All moving parts of the apparatus are sufficiently rugged to stand long periods of use. Long periods of use are further assured due to that fact that the consistency of solid constituent (and hence the consistency of building material flowing into and being evacuated from the container 17) varies only when a change in consistency is desired. Thus, the moving parts, their bearings, seals and/or prime movers are not subjected to stresses which fluctuate within a wide range such as is conducive to rapid and pronounced wear.

Figure 4:
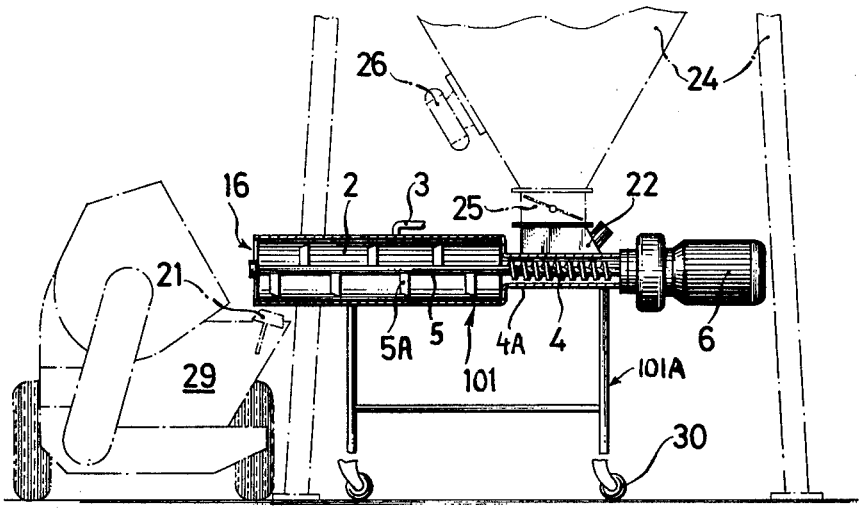
FIG. 4 is a fragmentary partly elevational and partly sectional view of a second apparatus.

FIG. 4 shows a portion of a modified apparatus 101 having a different frame 101A mounted on rollers or analogous rotary elements 30. The housing 4A of the feeding unit for solid constituent has an upwardly extending inlet 22 which can be separately connected with means for supplying solid constituent into the range of the feed screw 4. The supplying means includes a conical silo or hopper 24 wherein the pressure equals atmospheric pressure. The silo 24 has a downwardly extending outlet 25 which can be coupled to the inlet 22. The solid constituent can be fed into the silo 24 at regular or irregular intervals, or at a constant rate. The apparatus 101 preferably further comprises a vibrator 26 or analogous means for agitating or shaking the silo 24 to thus promote the movement of solid constituent toward and into the outlet 25.

The outlet 16 of the vessel 2 discharges building material into a container 29 forming part of a wheel-mounted mortar mixing machine. The mixing device of the machine can but need not be in operation when the container 29 assures the position shown in FIG. 4 because the homogeneousness of building material issuing from the vessel 2 via outlet 16 is satisfactory for immediate application of such building material to walls or the like. The mixing machine including the container 29 is normally provided with at least one pump or analogous evacuating means for one or more streams of building material. The detector 21 is analogous to the detector 21 of FIG. 1, i.e., it can be operatively connected with the prime mover 6 to arrest the latter when the container 29 is filled to capacity.

The manner in which the two feeding units cooperate with the evacuating unit 5, 5A to insure that the vessel 2 always contains the same quantity of building material but is not filled to capacity is the same as described in connection with FIGS. 1 to 3. The main difference between the apparatus 1 and 101 is that the latter does not have a container which is mounted on or supported by the frame 101A and also that the means for supplying solid constituent to the housing 4A does not or need not include a pneumatic conveyor. The silo 24 can receive material from a chute or directly from bags.

Figure 5:
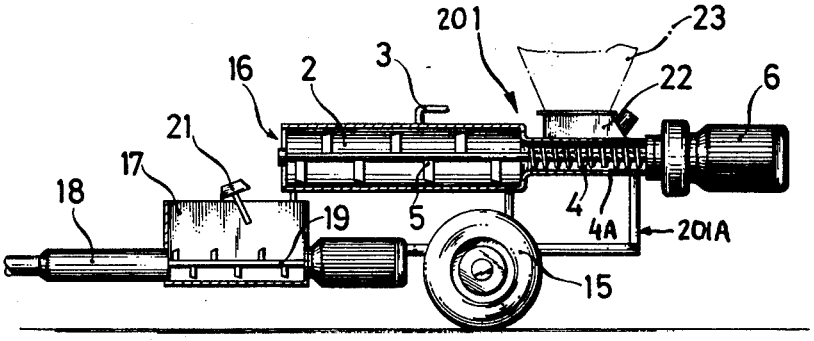
FIG. 5 is a similar view of a third apparatus.

FIG. 5 shows a third apparatus 201 which embodies certain features of the apparatus 1 and 101. The frame 201A supports the two feeding units, the vessel 2 and the receptacle 17 with one or more evacuating pumps 18. The inlet 22 of the housing 4A is coupled to the outlet at the lower end of a receptacle 23 here shown as a conical magazine or hopper which can receive solid constituent from bags or from a conveyor, e.g., a chute or a pneumatic conveyor, not shown.

Figure 6:
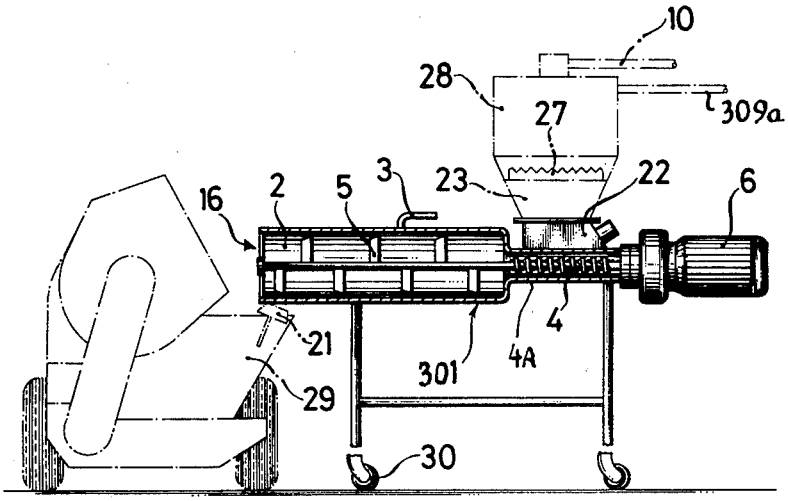
FIG. 6 is a similar view of a fourth apparatus.

FIG. 6 shows an apparatus 301 which constitutes a modification of the apparatus 101. The inlet 22 of the housing 4A is separably coupled to the conical outlet 23 of an upright receptacle 28 which receives solid constituent from a pneumatic conveyor including a pipe 309*a*. The gaseous carrier medium is evacuated by way of a conduit 10 (e.g., a flexible hose) and preferably passes through a filtering unit (not shown) prior to being discharged into the atmosphere. The lower portion of the receptacle 28 contains one or more devices 27 for breaking or opening of bags which are dropped into the receptacle and contain batches of solid constituent. The illustrated breaking device 27 comprises a substantially horizontal toothed bar or strip whose teeth face upwardly. The receptacle 28 may but need not be agitated by a device analogous to the vibrator 26 of FIG. 4. The upper portion of the receptacle 28 may constitute a hood which is detachable from the outlet 23 and is connected to the pneumatic conveyor as well as to the filtering unit in a manner analogous or similar to that described in connection with the hood 8 of the apparatus 1. If the upper portion or hood of the receptacle 28 is removed, the outlet 23 constitutes a relatively small receptacle or hopper which can receive the contents of one or more bags at a time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. Apparatus for the preparation of plastic building material which includes solid and liquid constituents, particularly for continuous preparation of mortar, comprising a mixing vessel; first and second feeding means for respectively admitting into said vessel metered quantities of solid and liquid constituents whereby such constituents are converted into building material in the interior of said vessel; means for evacuating building material from said vessel at such a rate that the quantity of material in the interior of said vessel is at least substantially constant and the vessel is filled to less than capacity; a container for the material which is evacuated from said vessel; and means for arresting at least one of said feeding means, including a level detector arranged to monitor the quantity of building material in said container and to effect stoppage of said one feeding means when the quantity of building material in said container exceeds a predetermined quantity.

2. Apparatus as defined in claim 1, wherein said first feeding means comprises a screw conveyor.

3. Apparatus as defined in claim 1, wherein said vessel has an outlet and said evacuating means comprises a rotary member mounted in the interior of said vessel and having means for advancing building material toward and through said outlet in response to rotation of said member.

4. Apparatus as defined in claim 3, wherein said advancing means comprises paddles.

5. Apparatus as defined in claim 3, wherein said first feeding means comprises a rotary feed screw which is coaxial with said rotary member, and further comprising a common prime mover for said feed screw and said rotary member.

6. Apparatus as defined in claim 5, wherein the common axis of said feed screw and said rotary member is horizontal.

7. Apparatus as defined in claim 1, wherein said first feeding means comprises a conveyor including a housing and a rotary feed screw in said housing, said housing having an inlet and further comprising means for supplying said solid constituent to said housing from above via said inlet.

8. Apparatus as defined in claim 7, further comprising means for separably connecting said supplying means to said inlet.

9. Apparatus as defined in claim 7, wherein said supplying means comprises a hopper located at a level above said inlet.

10. Apparatus as defined in claim 7, wherein said supplying means comprises a silo for a supply of solid constituent.

11. Apparatus as defined in claim 10, wherein the interior of said silo is maintained at atmospheric pressure.

12. Apparatus as defined in claim 7, wherein said supplying means comprises a receptacle for a supply of solid constituent.

13. Apparatus as defined in claim 1, further comprising a receptacle for a supply of solid constituent and penumatic conveyor means for admitting into said receptacle a mixture of solid constituent and a gaseous carrier medium, said receptacle having a first outlet in communication with said first feeding means and a second outlet for said carrier medium.

14. Apparatus as defined in claim 13, further comprising a filtering unit for the gaseous carrier medium and means for connecting said filtering unit with the second outlet of said receptacle.

15. Apparatus as defined in claim 14, wherein said connecting means comprises a flexible conduit.

16. Apparatus as defined in claim 14, wherein said filtering unit is remote from said receptacle.

17. Apparatus as defined in claim 14, further comprising a hood for said receptacle.

18. Apparatus as defined in claim 17, wherein said filtering unit is separably mounted on said hood.

19. Apparatus as defined in claim 1, further comprising means for supplying said solid constituent to said first feeding means, said supplying means comprising a hopper arranged to store a supply of solid constituent and having an outlet in communication with said first feeding means, and further comprising means for breaking bags or analogous breakable containers for solid constituent, said breaking means being installed in said hopper so as to break a bag which is dropped into said hopper.

20. Apparatus as defined in claim 19, wherein said breaking means comprises a toothed bar.

21. Apparatus as defined in claim 1, further comprising means for supplying said solid constituent to said first feeding means, including a receptacle having an outlet in communication with said first feeding means and pneumatic conveyor means for supplying into said receptacle a mixture of solid constituent and gaseous carrier medium.

22. Apparatus as defined in claim 21, wherein said receptacle includes a hopper having an inlet for said mixture and a second outlet for evacuation of said carrier medium, said pneumatic conveyor means having a discharging portion including a hood mounted on said hopper.

23. Apparatus as defined in claim 1, wherein said last mentioned evacuating means comprises at least one pump.

24. Apparatus as defined in claim 23, wherein said pump has means for effecting a controlled discharge of building material in a selected direction.

25. Apparatus as defined in claim 1, further comprising means for mixing the constituents of building material in said container.

26. Apparatus as defined in claim 25, wherein said container has an outlet in communication with said pump and said mixing means comprises a rotary member mounted in said container and having means for advancing building material toward and into said outlet of said container, said pump having a second rotary member which is coaxial with said first mentioned rotary member and further comprising a common prime mover for said rotary members.

27. Apparatus as defined in claim 1, further comprising a plurality of mixing devices for the constituents of building material in said container, said last named evacuating means comprising a plurality of descrete pumps.

28. Apparatus as defined in claim 27, wherein each of said mixing devices comprises a first rotary member and each of said pumps comprises a second rotary member coaxial with one of said first rotary members.

29. Apparatus as defined in claim 1, wherein said last named evacuating means comprises a screw pump.

30. Apparatus as defined in claim 1, further comprising means for supplying solid constituent to said first feeding means including a receptacle in communication with said first feeding unit, a pneumatic conveyor having means for admitting into said receptacle a mixture of solid constituent and a gaseous carrier medium and means for evacuating said carrier medium from said receptacle, said last named evacuating means comprising a filtering unit and means for supporting said filtering unit.

31. Apparatus as defined in claim 30, further comprising a frame for said vessel, said feeding means and said receptacle, said filtering unit being supported by said frame.

32. Apparatus as defined in claim 1, further comprising a frame for said vessel and said feeding means, said container being separably supported by said frame.

33. Apparatus as defined in claim 1, further comprising a wheel-mounted frame for said vessel and said feeding means.

34. Apparatus for the preparation of hardenable plastic building material which includes solid and liquid constituents, particularly for continuous preparation of mortar, comprising a mixing vessel having a first outlet; first and second feeding means for repsectively admitting into said vessel metered quantities of solid and liquid constituents whereby such constituents are converted into building material in the interior of said vessel; means for evacuating building material from said vessel by way of said outlet; a container for the material which is evacuated from said vessel by way of said outlet, said container having a second outlet; means for evacuating building material from said container, including at least one pump in communication with said second outlet, said pump having a first rotary member; means for mixing the constituents of building material is said container, including a second rotary member mounted in said container, coaxial with said first rotary member and having means for advancing building material toward and into said second outlet; and a common prime mover for said rotary members.

35. Apparatus as defined in claim 34, further comprising means for arresting at least one of said feeding means, including a level detector arranged to monitor the quantity of building material in said container and to effect stoppage of one said feeding means when the quantity of building material in said container exceeds a predetermined quantity.

36. Apparatus for the preparation of plastic building material which includes solid and liquid constituents, particularly for continuous making of motar, comprising a mixing vessel having a first outlet; first and second feeding means for respectively admitting into said vessel metered quantities of solid and liquid constituents whereby such constituents are converted into building material in the interior of said vessel; means for evacuating building material from said vessel by way of said outlet; a container for the material which is evacuated from said vessel by way of said outlet, said container having a plurality of second outlets; and means for evacuating building material from said container by way of said second outlets, including a plurality of pumps each communicating with a discrete second outlet.

* * * * *